United States Patent [19]

Pedi

[11] 4,262,565

[45] Apr. 21, 1981

[54] SLICING APPARATUS HAVING VARIABLE THICKNESS CONTROL

[76] Inventor: Mario J. Pedi, 16 Wickham Rd., Winchester, Mass. 01890

[21] Appl. No.: 93,239

[22] Filed: Nov. 13, 1979

[51] Int. Cl.[3] ..... B26D 4/42

[52] U.S. Cl. ..... 83/71; 83/102; 83/717

[58] Field of Search ..... 83/71, 102, 717, 718, 83/714

[56] References Cited

U.S. PATENT DOCUMENTS

| | | | |
|---|---|---|---|
| 2,433,600 | 12/1947 | Cohen | 83/717 |
| 2,621,693 | 12/1952 | Grills | 83/717 X |
| 3,736,829 | 6/1973 | Pedi | 83/714 X |
| 3,832,929 | 9/1974 | Pedi | 83/714 |

OTHER PUBLICATIONS

Marped Engineering Co., Inc., Brochure, "Automatic Frozen Food Block Cutting System".

*Primary Examiner*—Frank T. Yost

*Attorney, Agent, or Firm*—Kenway & Jenney

[57] ABSTRACT

Improved apparatus for automatically cutting multiple slices from a block of frozen food material includes a repositionable block-guiding fence whose position relative to a saw blade determines the thickness of the slices. A programmable controller is preset before a slicing sequence to produce a desired number of thin slices before actuating a fence-repositioning mechanism, thereby increasing the thickness of the slices cut from the remainder of the block. The controller is recycled automatically and the fence returns to its initial position before a new block is sliced. A slice-restraining arm mounted on the fence prevents a completed slice from being reinserted between the fence and the saw and from interfering with the return movement of the fence.

6 Claims, 7 Drawing Figures

SLICING APPARATUS HAVING VARIABLE THICKNESS CONTROL

BACKGROUND

This invention relates to an automatic mechanism for repeatedly cutting slices from a block of frozen food material. In particular the invention provides an improvement whereby the mechanism can be programmed to change the thickness of the slices at a specific point in the slicing sequence and then resume cutting slices of the original thickness upon the start of the next sequence. The programmable adjustment can provide at least two different thicknesses from each block of material.

The present invention represents an improvement in slicing apparatus as disclosed in U.S. Pat. No. 3,736,829 and No. 3,832,929 issued to applicant, and the contents of those patents are hereby incorporated into this application by reference.

The automatic slicing apparatus disclosed in U.S. Pat. No. 3,736,829 and No. 3,832,929 is particularly useful in the frozen fish processing industry. In that industry, standard-size frozen blocks of flaked and compressed fish are subdivided into individual portions of suitable size for restaurant and home use. Generally, it is inefficient to use a single slicing machine to divide a single block of frozen fish into the smallest desired components. Rather it is more advantageous to use a primary saw to divide the main block into a group of smaller slabs which are then distributed to auxiliary slicers to be subdivided further. Once a fish processer has identified the size of the initial block of frozen fish, the size of the resulting end products, and the number of pounds per hour to be processed, he can determine the configuration which will achieve this desired production output most efficiently.

For example, assume that the processer is to divide the frozen block into twenty slices of equal thickness, each of which eventually will be cut into individual portions. If only a single slicing machine is used, nineteen individual cuts through the block will be required to provide the twenty finished slices, assuming there is no residue to be trimmed. However, if there is an additional slicing machine having similar capabilities, the primary saw can be adjusted to divide the initial block into ten slabs of double the desired thickness. Thus the primary saw will make only nine slicing cuts to produce the thicker slabs, instead of the nineteen cuts in the previous situation. Then each of these slabs is fed to the second saw to be further subdivided into the two individual slices, while simultaneously the primary saw continues to produce more slabs. In this way the same amount of finished product is produced in approximately half the time.

Alternatively, if additional auxiliary saws are provided, the primary saw can be set to divide the initial block into five slabs comprising four slices each. Obviously, this requires the primary saw to make only four cuts per block. Then the five-slice-thick slabs can be fed on a staggered basis into various auxiliary slicers. In this manner, assuming that the proper number of auxiliary saws is used to keep up with the output of the primary saw, the same amount of finished product can be generated in approximately one-quarter of the time required by the primary saw alone.

Such slicing and feeding arrangements are known in the art. However, there is a particular situation in which a lack of flexibility in the primary saw limits the increase in productivity achievable with such an arrangement. For example, consider the case where the initial block of material is to be divided into a number of slices which is a prime number, that is, a number divisible only by itself or the number one, e.g. nineteen. In order to increase production considerably, the block could be separated into six slabs comprising three slices each and be distributed to auxiliary slicers as above. However, there will be a single-thickness slice left over after the six slabs are removed. Typically, the auxiliary saws do not have the capability for processing and handling the single-thickness slice. Separate handling personnel or equipment are required to convey this slice to the area where the final slices are cut up into the finished product. Due to this added expense, generally the single slice is set aside until a sufficient number have been accumulated, and then a group of individual slices is broken down into the final form by a manual cutting operation, which is understandably time-consuming, inefficient and uneconomical.

Another problem encountered in the prior art is the tendency of a finished slice to adhere to the remainder of the block upon completion of a single cutting stroke, typically due to melting and subsequent refreezing of the abutting surfaces. When the remainder of the block is retracted to an initial position for the removal of additional slices, it draws the adhering slice partially back toward the initial position. The retracted slice interferes with further slicing operations.

Accordingly, it is an object of the present invention to provide a mechanism for optimizing the productivity of a frozen food slicing apparatus by producing slabs of different thicknesses automatically from a single block of frozen material.

It is a further object of the present invention to enhance the productivity of existing automatic slicing apparatus in an efficient, inexpensive, and reliable manner.

It is a further object of the present invention to ensure that completed slices, which have been severed from a block of material, are not reinserted into the operating area of a slicing apparatus to interfere with subsequent slicing operations.

SUMMARY OF THE INVENTION

A slicing apparatus according to this invention includes a saw and a lineal fence adjacent the saw and along which a unit of frozen material is guided past the saw. The distance between the fence and the saw defines the thickness of the slice being cut. A clamping jaw holds the unit of material firmly against the fence while it is being sliced, and a transport table cyclically advances the unit of frozen material along with the engaged clamping jaw from a starting position, where the unit is disengaged from the saw, along the fence into engagement with the saw, and finally to a position beyond the saw. This advance produces a complete slice. The transport mechanism returns the unsliced remainder of the unit to the starting position. A repositioning mechanism is coupled to reposition the fence rapidly at different distances from the saw. Stops define the locations at which the fence is repositioned. A programmable controller controls the repositioning mechanism to reposition the fence automatically between successive cycles of the transport mechanism, thereby to provide slices of different predetermined thicknesses from the same unit of material.

In a preferred embodiment of the invention, a programmable pneumatic controller actuates a pneumatic cylinder, which in turn selectively positions the fence. The pneumatic controller is preset to actuate the pneumatic cylinder after the cutting of a predetermined number of slices of a particular thickness. The cyclical movements of the transport table actuate a switching mechanism which indexes the controller. Further, the invention provides a pivotable restrainer arm mounted on the fence for preventing a completed slice from being reinserted between the fence and the saw. The restrainer arm hence prevents the slice just cut from being jammed against the saw when the fence is repositioned to cut a slice of a lesser thickness.

An automatic frozen-fish cutting saw fitted with the foregoing improvements offers the following advantages. Faced with the task of dividing the block into nineteen slices of equal thickness, a processer can program the saw to produce three slabs comprising five slices each and one slab comprising four slices. The output of the primary saw is channeled into auxiliary saws, one for slicing the five-slice-thick slab into individual slices and the other for slicing the four-slice-thick slab. This arrangement would avoid the aforementioned problem which is accompanied by melting and potential spoilage of the fish. Without the additional manual steps, the entire slicing operation, from the time the blocks are loaded into the primary saw until the finished products are discharged, can be automated completely.

BRIEF DESCRIPTION OF THE DRAWINGS

For a fuller understanding of the nature and objects of the invention, reference should be made to the following detailed description and the accompanying drawings, in which.

DESCRIPTION OF ILLUSTRATED EMBODIMENT

Figure 1:
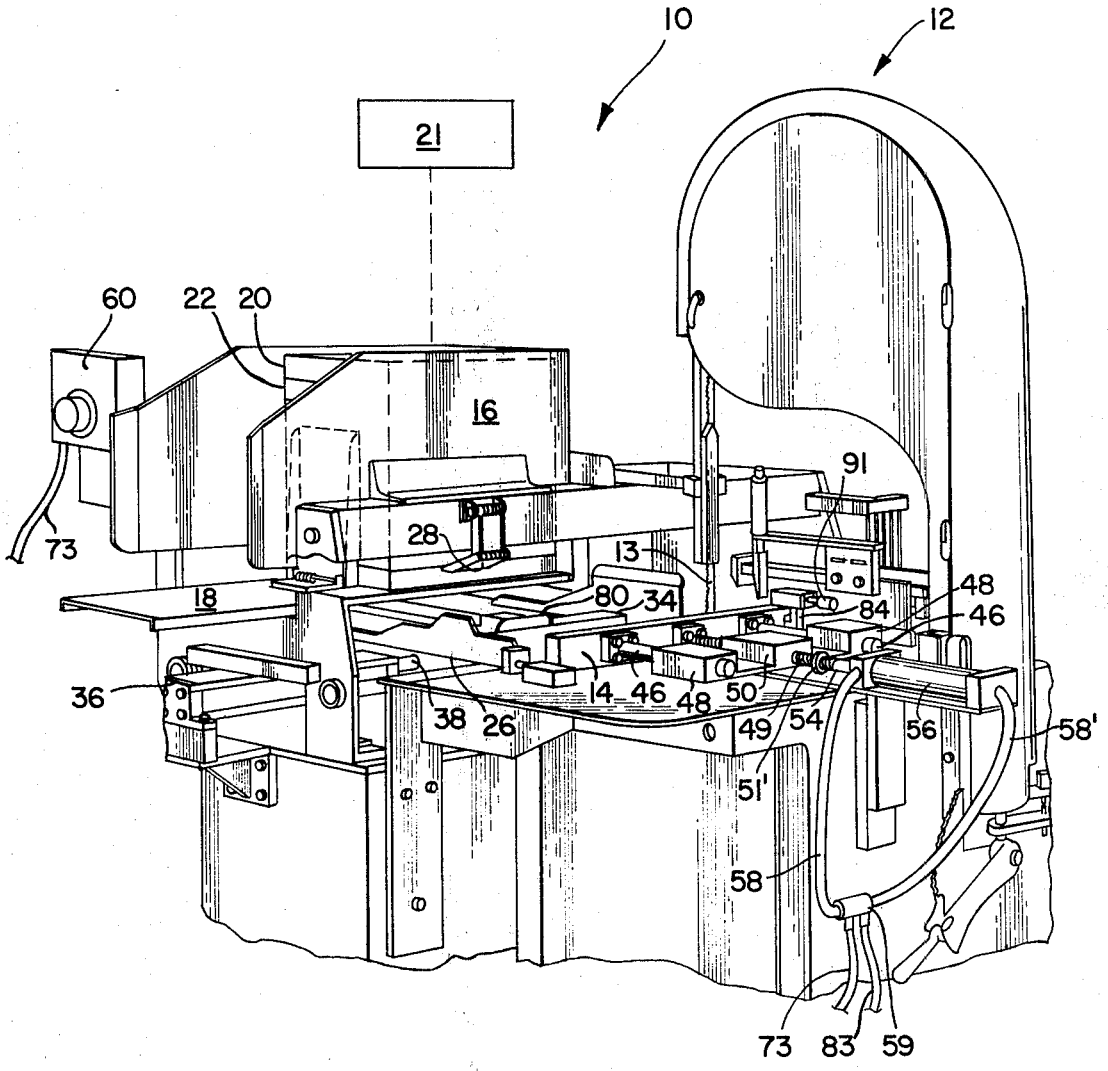
FIG. 1 is an overall perspective view of a slicing machine embodying features of the invention.
Figure 2:
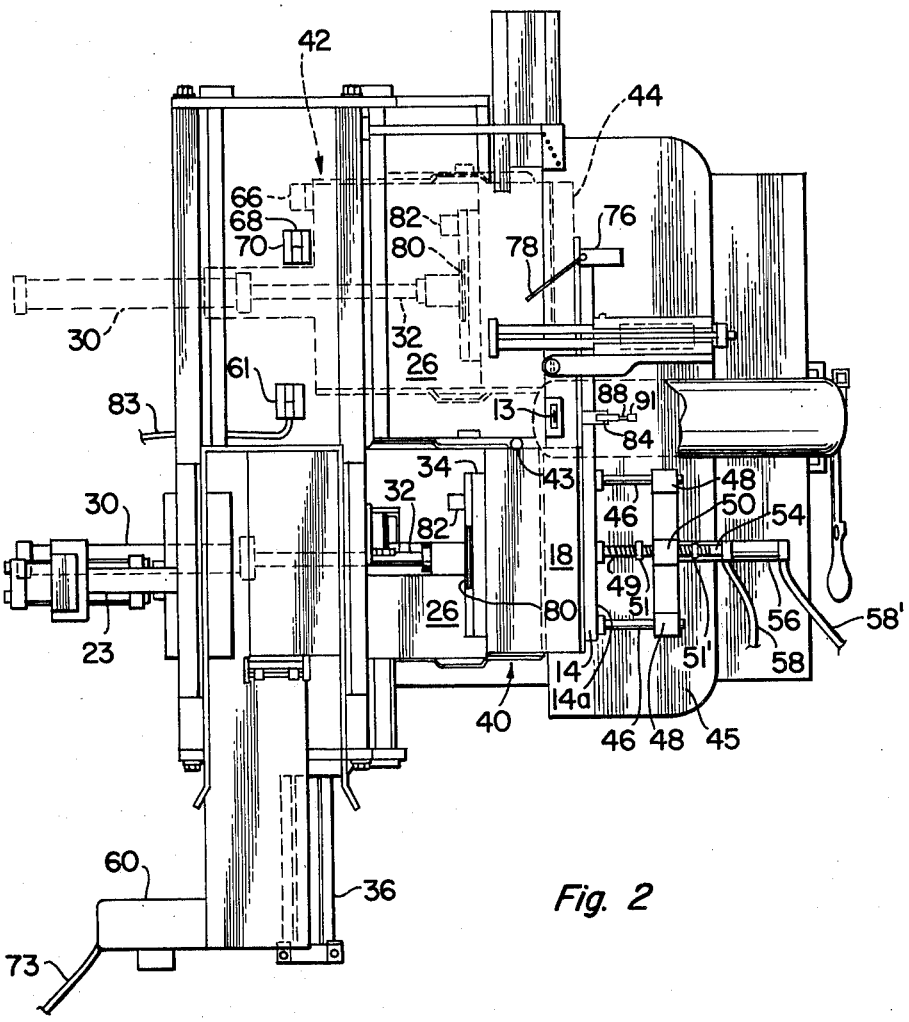
FIG. 2 is a top plan view of the machine in FIG. 1.

The general arrangement of an automatic slicing apparatus embodying the invention is as follows. Referring to FIGS. 1 and 2, an automatic slicer 10 embodying the invention utilizes a conventional band saw 12 which has a blade 13 disposed adjacent a generally straight fence 14. The fence is parallel to the plane of the saw blade 13 and extends on either side of it. A storage magazine 16 mounted above a horizontal support surface 18 holds a stack 20 of rectangular frozen food blocks 22. At an appropriate time in the slicing sequence, as determined by a central control unit 21, a pneumatic cylinder 23 drives a piston (not shown) against the bottommost block in the stack and dispenses it into the open space on a transport table 26. The block, aided by gravity and the downward urging of a spring-loaded guide arm 28, drops into position on the transport table. A second pneumatic cylinder 30, mounted on the table 26, pushes a second piston 32 outwardly toward the block 22 until a transverse clamping jaw 34 carried on the piston 32 engages the vertical side of the block and pushes the block firmly against the opposing fence.

A third pneumatic cylinder 36 controls the reciprocating movement of a piston 38 coupled to the transport table to move the transport table back and forth between an initial loading position 40, at which the block is deposited, and a final position 42 near the far end of the fence. FIG. 2 shows the transport table with solid lines in the initial position 40 and with broken lines in the final position 42. As the transport table moves from the initial position to the final position, the second pneumatic cylinder 30 and its associated piston 32 move with the table, and keep the block firmly pressed against the fence. The block of material accordingly slides along the fence as it advances with the table. As the block advances, the saw blade engages a leading edge 43 of the block and cuts through the block until a slice 44 has been severed. The thickness of the slice depends on the lateral distance between the saw blade and the fence.

Upon completion of this slice-cutting advance, the transport table returns to the initial position with the remainder of the block. The piston-urged clamping jaw 34 presses the remainder of the block tightly against the fence so that the slicing cycle can be repeated. Succeeding slices are removed from the remainder of the block in a similar manner until the entire block is depleted. After the final slice has been discharged along with any residue and the piston 32 retracts the clamping jaw 34, the empty transport table again returns to the initial position to receive a new block of material from the stack. The sequence then repeats.

A more precisely detailed description of the operation of the basic slicing apparatus to which the invention is an improvement, can be found in the above-mentioned patents which have been incorporated by reference.

With particular reference to FIG. 2, the fence 14 is supported above a fixed worktable 45 by an assembly of two cylindrical rods 46, which firmly attach to the back side **14*a* of the fence 14 and extend transversely thereto into sliding engagement with two corresponding bearing blocks 48. The sliding of the rods within the bearing blocks permit adjustment of the fence relative to the saw blade. A central drive rod 49 similarly attaches to the backside of the fence. This drive rod 49 is threaded externally and it passes through a clearance hole in a support block 50. A pair of internally threaded annular mechanical stops 51, 51' engage the threaded rod 49, one on either side of the support block 50. These mechanical stops define the limits of movement of the drive rod 49 within the support, and consequently determine both the closest and farthest points of approach of the fence 14 to the saw blade 13. Rotating the stops about the threaded drive rod 49** allows them to move axially therealong to the positions selected to achieve the desired slice thicknesses.

Figure 4A:
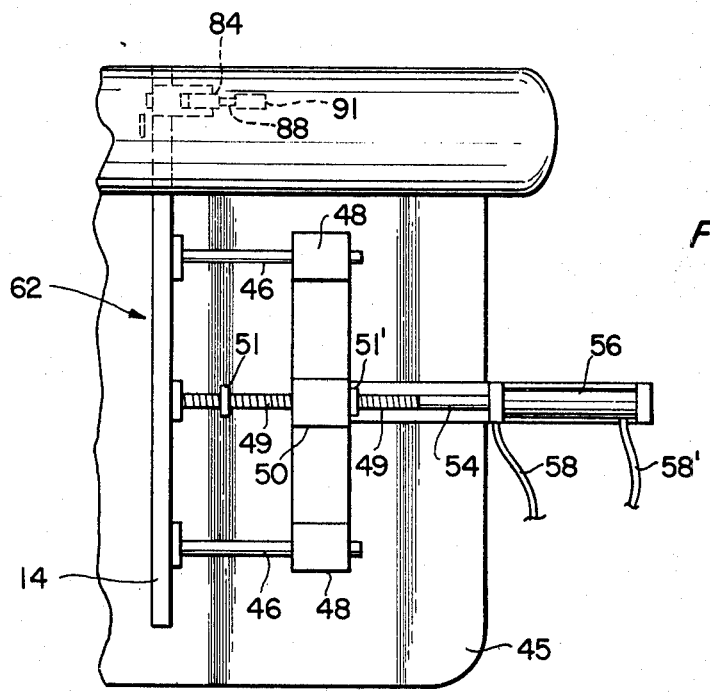
FIGS. 4A and 4B are top plan views of the adjustable fence showing extended and retracted positions thereof, respectively.
Figure 4B:
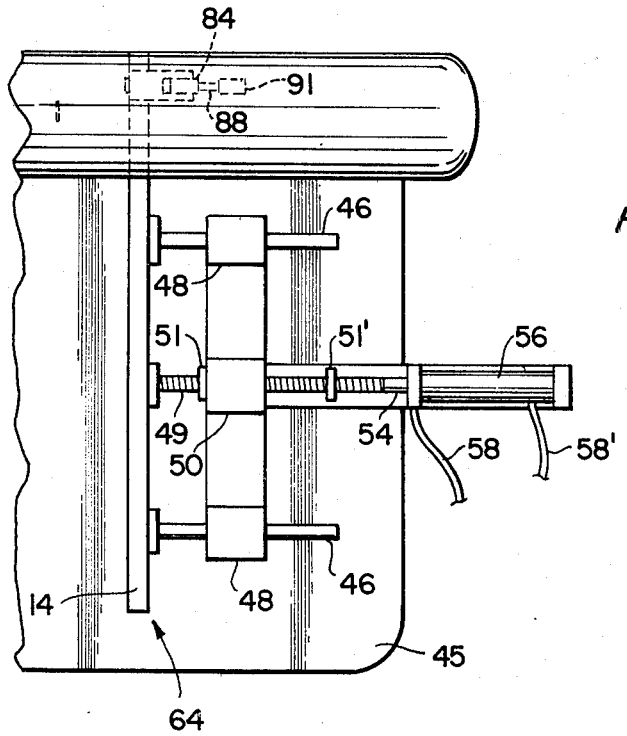

Referring now to FIGS. 2, 4A and 4B, in the illustrated embodiment the drive rod 49 is coupled to a piston 54, which is driven by a pneumatic cylinder 56. The pneumatic cylinder 56 receives actuating signals via either of lines 58, 58' from the output of a switching valve 59 (FIG. 1) as determined by a programmable controller 60 (FIG. 1) and a switching mechanism 61, whose operations will be described hereinafter. Until actuated by the controller, the illustrated cylinder 56 is driven by a signal supplied on the line 58' to position the piston 54 and the fence toward the left (FIG. 4A) until the mechanical stop 51' abuts the support block 50. The fence then occupies an extended position 62 shown in FIG. 4A. This is the normal position occupied by the fence at the start of a slicing sequence. At a selected stage during the slicing sequence, discussed further below, the controller switches the output of the switching valve from line 58' to line 58. In response, the cylinder 56 drives the piston 54 and the fence 14 to a rightmost retracted position 64, defined by the stop 51, as shown in FIG. 4B. This movement increases the thickness of the slices produced by the saw during subsequent cutting of the same block of material.

Figure 2A:
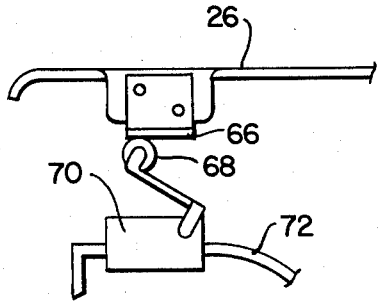
FIG. 2A is a fragmentary elevation view showing the interaction of a switch mechanism with a cam on the reciprocating transport table of the machine of FIG. 1.

The controller 60, shown in FIG. 1, is a conventionally available device which can be preset, typically before the start of a slicing sequence, to produce an actuating output signal after it has received a predetermined number of input signals. In the illustrated machine the input signals correspond to the number of slices which have been removed from the block. Referring to FIGS. 2 and 2A, an L-shaped bracket 66 depends from the underside of the transport table 26. The bracket 66 is designed to come into engagement with and actuate an actuating arm 68 of a switch 70 mounted to the machine frame beneath the final position 42 of the transport table. A line 72 connects the switch to the controller 60. The switch 70 can be of a type to produce either an electrical, pneumatic or any other appropriate output, depending on the type of controller used. A line 73 joins the controller 60 to the switching valve 59. Each time the transport table advances to the final position 42, the bracket 66 actuates the switch 70, indicating completion of a slicing cycle. After the controller receives a predetermined number of indexing signals from the switch 70, it actuates the switching valve 59 to switch its output signal to the line 58. Upon receipt of the signal on line 58, the pneumatic cylinder 56 pushes the piston to the right to move the fence into the retracted position 64 (see FIG. 4B). The fence remains in this position until the block being sliced during that particular sequence is completed.

Referring again to FIG. 2, a switch 76 mounts on top of the fence 14, adjacent the final position 42 of the transport table. An actuating lever 78 of the switch 76 extends beyond the fence at such a height that it does not interfere with the movement of the block as it slides cyclically along the fence. A flange 80 extends upwardly from the top surface of the clamping jaw, to the height of the actuating lever 78. The length of the actuating lever 78 is such that it contact the flange 80 only when the final slice is being cut, and the jaw has moved to its rightmost position to hold the final portion of the block against the fence. The switch 76 connects to the control unit 21 (FIG. 1) by a signal line (not shown), and the control unit in turn can communicate with the cylinder 32. Thus, when the flange 80 actuates the switch 76 during the final slicing cycle of a particular block, the control unit 21 signals the cylinder 32 to retract the jaw all the way to the left.

A cam 82 depends from the bottom surface of the jaw 34 at the proper height to strike a cam-following actuator arm (not shown) of a switch mechanism 61 positioned beneath the jaw. The output of the switching mechanism 61 connects to the switching valve 59 via a line 83 (FIG. 1). This switch mechanism 61 is positioned in such a way that it is actuable by the cam 82 only if the clamping jaw 34 has been retracted all the way to the left, as described in the previous paragraph, before the transport table with the attached clamping jaw returns from its final position 42 to its initial position 40. So the cam 82 actuates the switching mechanism 61 only once during a slicing sequence, after completion of the final slice. Once actuated, the switching mechanism 61 signals the switching valve 59 to switch its output from line 58 to line 58', thereby reversing the movement of the piston 54 and returning the piston-driven fence 14 to its normal extended position.

Prior to the start of a new sequence, as the fence 14 returns from its retracted position 64 (FIG. 4B) to the extended position 62 (FIG. 4A), it is important that there be no slice from the preceding block left in the space between the fence and the saw blade. Since, with the illustrated embodiment, the last slices from the block are thicker than the initial slices due to the left-to-right movement of the fence during the sequence, a thicker slice remaining between the fence and the saw blade will be pushed against the blade, with the possibility of breaking the blade. Therefore, it is important that the final slice remain in the final position to which it has been advanced by the transport table, a position in which its trailing edge is clear of the saw blade, despite any tendency of the slice to adhere to the transport table during the return movement to the initial position. For this purpose the invention provides a slice restraining arm 84.

Figure 3A:
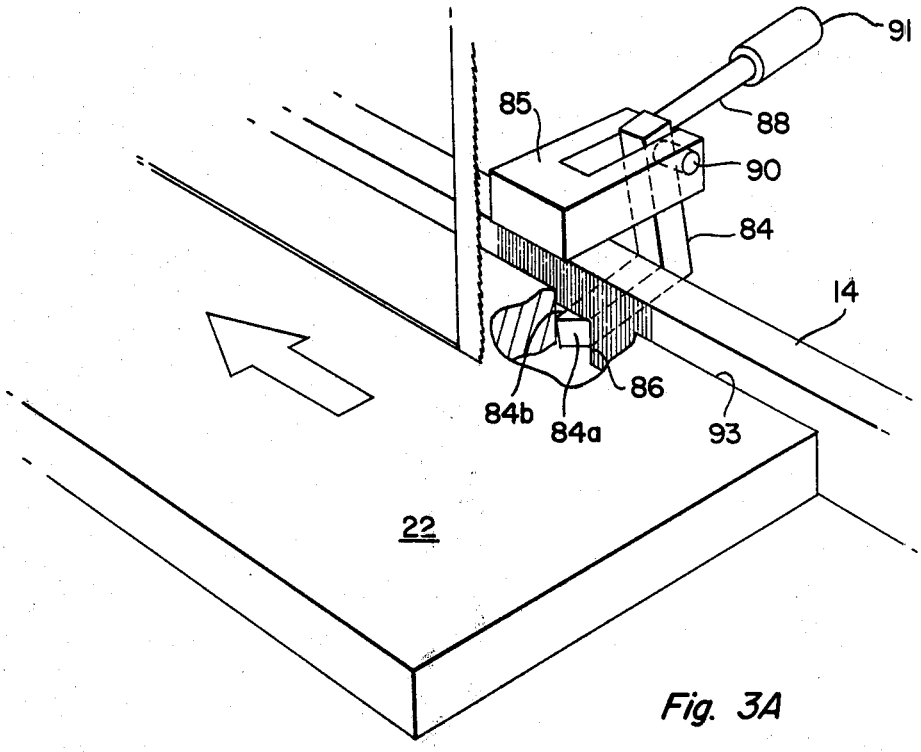
FIGS. 3A and 3B are perspective views showing the slice restraining arm as positioned both during and after completion of a slice.
Figure 3B:
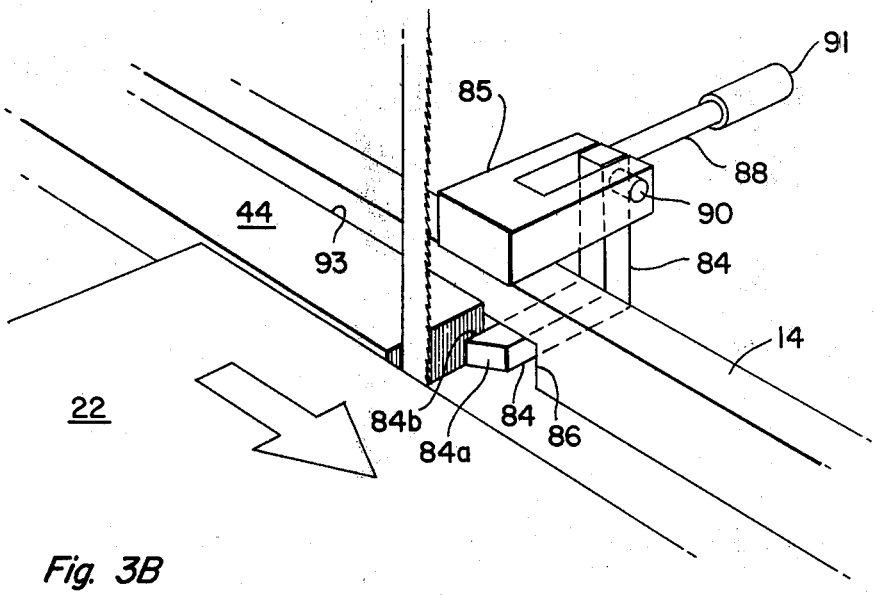

Referring to FIGS. 2, 3A and 3B, the slice restraining arm 84 is pivotably mounted by a bracket 85 illustrated as secured to a top edge of the fence. The bracket thus moves with the fence as it is translated between the extended and the retracted positions. The bracket 85 thus maintains the restraining arm in the same orientation relative to the fence regardless of the thickness of slices being cut. The lower end of the arm 84 protrudes through an opening 86 cut into the side of the fence. This lower end has a front tapered surface **84*a* and a rear, slice-obstructing surface 84*b*. A counterbalance arm 88 is fastened to the restraining arm 84 at a pivot point 90 on the bracket 85, and a weight 91 which engages the counterbalance arm pivots the restraining arm through the opening 86** until stopped by a preset restraint (not shown).

The tapered surface **84*a* of the restraining arm is disposed in such a way that as a block advances along the fence from the initial position to the final position, the leading edge 43 of the block strikes the tapered surface and develops a force component which urges the arm to the right into the opening. Thus the tapered surface functions in the manner of a cam pushing against a cam follower, the leading edge of the block serving as the cam. The presence of the side wall 93 of the block (FIG. 3A) against the opening keeps the tapered surface of the restraining arm within the opening until the entire block moves unimpededly past the point of protrusion. However, the transport table delivers the completed slice to a position beyond the point of protrusion so that the restraining arm, under the action of the counterbalance arm 88, can swing back through the opening and protrude into the area to the left of the fence 14. The slice-obstructing surface 84*b* of the restraining arm now is disposed toward the slice, and it prevents retraction of the slice backwards toward the initial position 40 (FIG. 2**). Thus in effect there is a one-way switching action which permits movements of the slice along the fence in one direction only, namely from the initial to the final position of the transport table, but not in reverse.

As illustrated in FIG. 3B any tendency of a slice 44 to adhere to a vertical surface of the block 22 from which it has been severed is negated by the slice-obstructing surface of the protruding restraining arm 84. Similarly, if the slice just finished is the final slice to be removed from the block, the presence of the protruding restraining arm will prevent the slice from moving due to adherence to the transport table. Thus, when the fence returns to its extended position as described above, there can be no danger of any slice coming between the fence and the blade to cause damage to the blade.

A typical operating cycle of the illustrated improved automatic slicing machine proceeds as follows. Once the electrical and pneumatic supplies to the machine have been turned on, the empty transport table is advanced down the length of the fence by actuating a manually-operated cycle switch (not shown). Since the transport table is empty at this time, the flange 80 on the clamping jaw 34 strikes the actuating lever 78 of the switch 76 to signal the control unit 21 to return clamping jaw 34 and the transport table 26 to the appropriate positions to accept a new frozen-food block from the storage magazine. This initial cycling of the empty transport table establishes the proper phase relationships among the various interacting mechanisms at the beginning of an automatic feed sequence. Once these relationships have been established, an operator can set the programmable controller to the number of initial thin slices to be made before the fence is repositioned to produce thicker slices. The blocks of frozen food material are loaded into the magazine. The table again is cycled forward empty and returns to receive the first block. At the start of the sequence, the fence is in its leftmost extended position for the cutting of thin slices. When the number of thin slices programmed into the controller have been cut, the fence, upon a signal from the controller, moves to its rightmost retracted position and the slicing operation continues, only this time providing the thicker slices. Slicing continues until the entire block is sliced, after which the machine re-establishes the proper relationships among the components to start a new sequence.

The present invention retains the flexibility to be used in the same operating mode as the invention disclosed in the above-referenced patent, namely to supply slices of uniform thickness throughout the block of material, by the simple expedient of disabling the controller 60, e.g. by disconnecting the supply line to the controller. This bypasses the controller 60 and allows the fence to remain in a stationary position, as determined by setting mechanical stops 51, 51' snuggly against both sides of the support block 50.

It is to be understood that the following claims are intended to cover all of the generic and specific features of the invention herein described and all statements of the scope of the invention, which as a matter of language, might be said to fall therebetween.

Having described the invention, what is claimed as new and secured by Letters Patent is:

1. In apparatus for repeatedly cutting slices from a unit of comestible material, said apparatus having a saw, a lineal fence adjacent said saw along which said unit is guided past said saw, the distance between said fence and said saw defining the thickness of a slice, clamping means for holding said unit firmly against said fence, and transporting means for cyclically advancing said unit with said clamping means from a starting position where the unit is disengaged from said saw, along said fence into engagement with said saw to a final position beyond said saw to effect a completed slice, and returning the unsliced remainder of said unit to said starting position, the improvement comprising means for supporting said fence for the rapid repositioning thereof, fence-repositioning means coupled to said fence for varying the distance between said fence and said saw, stop means for defining the locations at which said fence is repositioned, and programmable control means for actuating said repositioning means, whereby the fence can be repositioned automatically between selected successive ones of said cyclical advances to provide slices of different predetermined thicknesses from one said unit of material.

2. In apparatus as defined in claim 1, the further improvement comprising restraining means for blocking the reverse movement of each said completed slice from said final position when said transporting means returns said remainder of said unit to said starting position.

3. In apparatus as defined in claim 2, the further improvement wherein said restraining means comprises an arm arranged for movement with said fence unit, said arm being pivotably mounted and biased to a normal pivoting position where said end portion protrudes outwardly through an opening in said fence into the path of said unit, said end-portion having a tapered surface located for camming engagement with a leading edge of said unit, said engagement pivoting said arm out of said path, and said protruding end further having an obstructing surface opposite said tapered surface which blocks a slice moving from said final position toward said starting position.

4. In apparatus as defined in claim 1 and further having automatic unit feed means, the further improvement comprising means for resetting said programmable actuating means in response to each feeding of a new unit.

5. In apparatus for repeatedly cutting slices from a unit of comestible material, said apparatus having a saw, a lineal fence adjacent said saw along which said unit is guided past said saw, the distance between said fence and said saw defining the thickness of a slice, clamping means for holding said unit firmly against said fence, and transporting means for cyclically advancing said unit with said clamping means from a starting position where the unit is disengaged from said saw, along said fence into engagement with said saw to a final position beyond said saw to effect a completed slice, and returning the unsliced remainder of said unit to said starting position, the improvement comprising an arm pivotably mounted on said fence and biased to a normal pivoting position where said end portion protrudes outwardly through an opening in said fence into the path of said unit, said end-portion having a tapered surface located for camming engagement with a leading edge of said unit, said engagement pivoting said arm out of said path, and said protruding end further having an obstructing surface opposite said tapered surface which blocks a slice moving from said final position toward said starting position.

6. In apparatus for repeatedly cutting slices from a unit of comestible material, said apparatus having a saw, a lineal fence adjacent said saw along which said unit is guided past said saw, the distance between said fence and said saw defining the thickness of a slice, clamping means for holding said unit firmly against said fence, transporting means for cyclically advancing said unit with said clamping means from a starting position where the unit is disengaged from said saw, along said fence into engagement with said saw to a final position beyond said saw to effect a completed slice, and returning the unsliced remainder of said unit to said starting position, and automatic unit infeed means, the improvement comprising guide members fastened to said fence along which said fence can be translated transversely to its lineal axis, bearing blocks for supporting said guide members, a drive member fastened to said fence, a pneumatically operated piston coupled to said drive member to translate said fence along said guide members, a pair of adjustable stops to define the limits of motion of said drive member, a programmable pneumatic controller which actuates said piston upon completion of a predetermined number of slices from said unit of material, a switch actuated by said transporting means during advance of said unit toward said final position, which switch indexes said controller upon completion of each slice, a slice-restraining arm arranged for movement with said fence unit, said arm being pivotably mounted and biased to a normal pivoting position where said end portion protrudes outwardly through an opening in said fence into the path of said unit, said end-portion having a tapered surface located for camming engagement with a leading edge of said unit, said engagement pivoting said arm out of said path, and said protruding end further having an obstructing surface opposite said tapered surface which blocks a slice moving from said final position toward said starting position, and means for resetting said programmable pneumatic controller in response to each feeding of a new unit.

* * * * *